US007574881B1

(12) United States Patent
Wong et al.

(10) Patent No.: US 7,574,881 B1
(45) Date of Patent: Aug. 18, 2009

(54) RETRACTABLE KEY CHAIN

(76) Inventors: Tak Ko Wong, c/o T.K. Wong & Associates Ltd, Room 603. Futura Plaza, 111 How Ming Street, Kwun Tong, Kowloon, Hong Kong (CN); Charles Ka-Chow Ip, c/o T.K. Wong & Associates Ltd, Room 603, Futura Plaza, 111 How Ming Street, Kwun Tong, Kowloon, Hong Kong (CN)

( * ) Notice: Subject to any disclaimer, the term of this patent is extended or adjusted under 35 U.S.C. 154(b) by 0 days.

(21) Appl. No.: 12/072,456

(22) Filed: Feb. 26, 2008

(51) Int. Cl.
*A44B 15/00* (2006.01)

(52) U.S. Cl. ..... 70/456 R; 24/3.6; 24/300; 70/457; 70/458

(58) Field of Classification Search ..... 70/456 R, 70/457, 458, 459, 460; 24/3.6, 300, 301; 206/38.1, 37.1, 37.4–37.8; 40/330, 634
See application file for complete search history.

(56) References Cited

U.S. PATENT DOCUMENTS

| | | | | | |
|---|---|---|---|---|---|
| 613,029 | A * | 10/1898 | Fair | 24/13 |
| 1,094,568 | A * | 4/1914 | Hornich | 70/459 |
| 1,206,949 | A * | 12/1916 | Vaughan | 70/457 |
| 2,071,757 | A * | 2/1937 | Matthews | 206/38.1 |
| 2,527,175 | A * | 10/1950 | Brill | 206/37.1 |
| 2,737,046 | A * | 3/1956 | Jancsics | 70/457 |
| 2,871,902 | A * | 2/1959 | Weil | 206/38.1 |
| 3,604,232 | A * | 9/1971 | Mosher | 70/457 |
| 3,620,057 | A * | 11/1971 | Holland | 70/366 |
| 3,863,477 | A * | 2/1975 | Klein | 70/456 R |
| 3,956,913 | A * | 5/1976 | Howard | 70/456 R |
| 4,425,772 | A * | 1/1984 | Brewer | 70/456 R |
| 4,618,213 | A | 10/1986 | Chen | |
| 4,653,422 | A * | 3/1987 | Allen | 116/28 R |
| 4,821,543 | A * | 4/1989 | Scungio | 70/456 R |
| 5,052,602 | A * | 10/1991 | Duchi et al. | 224/218 |
| 5,253,393 | A * | 10/1993 | Levin | 24/301 |
| 5,755,127 | A * | 5/1998 | Huang | 70/456 R |
| 6,082,160 | A * | 7/2000 | Martyniak | 70/431 |
| 6,098,250 | A * | 8/2000 | Katz | 24/16 PB |
| 6,701,582 | B1 * | 3/2004 | Milburn | 24/72.1 |
| 6,708,375 | B1 * | 3/2004 | Johnson | 24/17 A |
| 2003/0009859 | A1 * | 1/2003 | Goss et al. | 24/302 |

FOREIGN PATENT DOCUMENTS

| | | |
|---|---|---|
| GB | 2391869 B | 11/2006 |

* cited by examiner

*Primary Examiner*—Lloyd A Gall
(74) *Attorney, Agent, or Firm*—Jackson Walker, LLP

(57) ABSTRACT

A lanyard or key chain having a non-coiled body with two connecting ends. The body is made of a resiliently deformable material and is stretchable between extended and retraced states.

7 Claims, 2 Drawing Sheets

RETRACTABLE KEY CHAIN

FIELD OF THE INVENTION

The present invention relates to lanyards and key chains. More particularly, but not exclusively, the invention is to lanyards and to key chains that is stretchable.

BACKGROUND OF THE INVENTION

Lanyards and key chains are widely available for holding small portable devices, badges and keys. Stretchable lanyards and key chains typically comprise a helically coiled cord made of metal or plastic. The cord has two ends. One end of the cord is connected to the user's belt or pocket and the other end is connected with a key or a small portable item. The cord is stretchable by way of partially straightening the helical coils so that the item to be carried can be used while always remaining connected with the user's belt or pocket.

The problem with this type of lanyard or key chain is that it is very inconvenient to travel with a long helically coiled cord. It can be dangerous and cumbersome if the cord is caught, for example, by a machines or a door knob. Also, the jangling of the cord can be rather disturbing.

OBJECT(S) OF THE INVENTION

It is an object of the present invention to overcome or substantially ameliorate at least one of the above disadvantages and/or more generally to provide a lanyard or key chain which is safer and more convenient to use.

SUMMARY OF THE INVENTION

According to the first aspect of the invention there is disclosed herein a key chain comprising a non-coiled body having first and second ends, the body being made of a a resiliently deformable material having elastic memory that is stretchable between extended and retracted states, and first and second connectors attached to the body first and second ends respectively.

Preferably, the extended state is more than twice as long as the retracted state.

Preferably, the first connecter is a ring shaped device adapted to receive one or more keys.

Preferably, the first and the second ends form integrated continuous lobes on either end of the non-coiled body.

Preferably, the resiliently deformable material is selected from a group consisting of, an elastic non-sticky gel material, a gelatinous composition, a melt blend admixture of poly (styrene-ethylene-butylene-styrene) triblock copolymer and plasticsing oils, latex and rubber.

Preferably, the non-coiled body is formed by injection molding.

Preferably, the gelatinous composition is a SEBS gelatinous composition.

Preferably, the key chain further comprising a badge.

Preferably, the non-coiled body has a centre region between the first and second ends and where the badge is a non-elastic badge located adjacent the centre region.

Preferably, the badge comprising first and second non-elastic members joined by legs extending through the elastic body.

Preferably, the extended state is more than ten times as long as the retracted state.

According to a second aspect of the invention there is provided a lanyard comprising a non-coiled body having first and second ends, the body being made of a resiliently deformable material having elastic memory that is stretchable between extended and retracted states, and first and second connectors attached to the body first and second ends respectively.

BRIEF DESCRIPTION OF THE DRAWINGS

An embodiment of the invention will be described by way of example only and with reference to the accompanied drawings in which.

DETAILED DESCRIPTION OF THE PREFERRED EMBODIMENT

Figure 1:
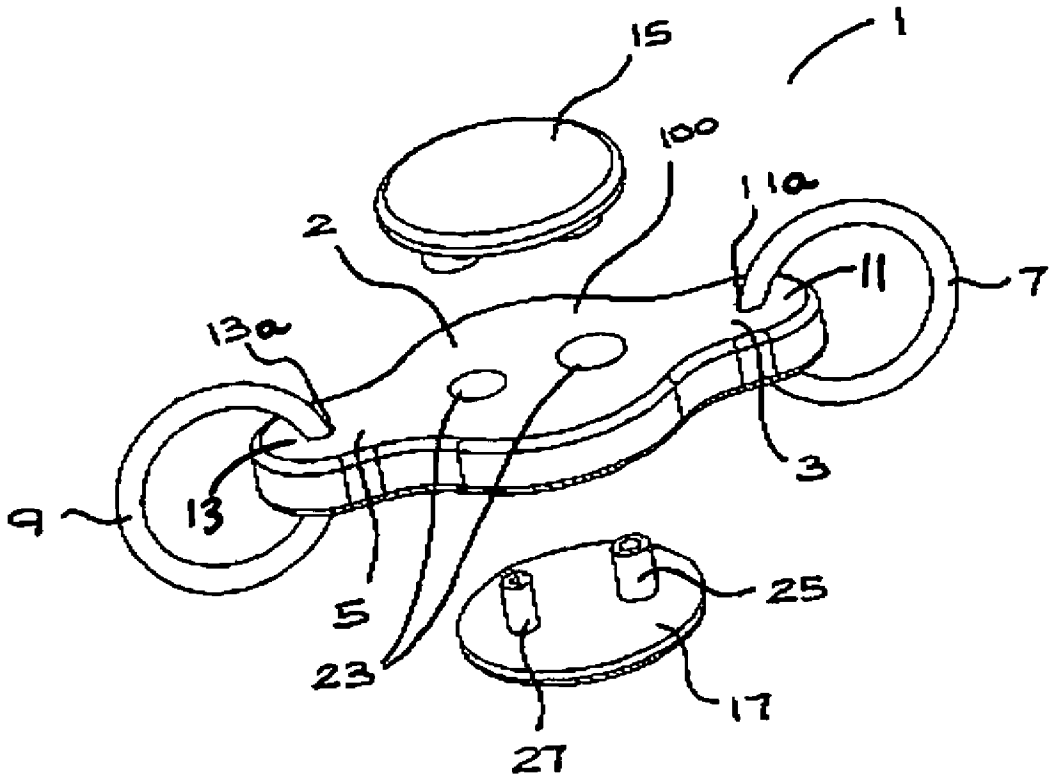
FIG. 1 is a schematic illustration of a key chain with badges.
Figure 2:
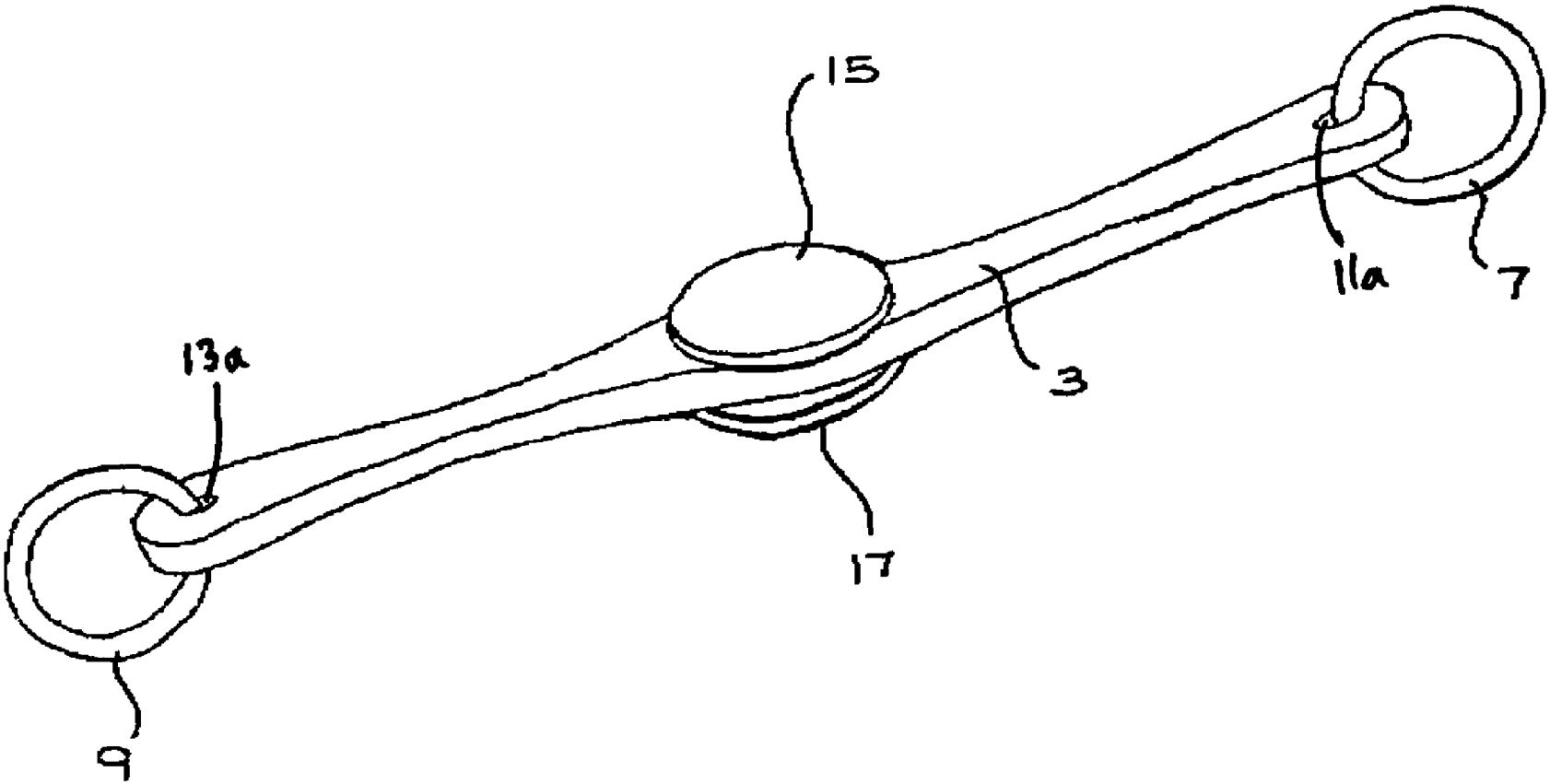
FIG. 2 is a schematic illustration of the key chain in an extended condition.

The current invention will now be described as practiced in a key chain. However, this is not intended to limit the scope of use or functionality of the invention. The skilled addressee will appreciate that the invention is equally applicable to lanyards generally.

In the drawings there is depicted a key chain 1. The key chain 1 has a non-coiled body 2 having a first end 3 and a second end 5. The non-coiled body 2 is made of a resiliently deformable material that is stretchable between extended and retracted states. The resiliently deformable material is highly elastic such that the extended state is more than twice as long as the retracted state and has elastic memory such that it may return to the first retracted state. The body is stretchable up to 10 times as long depending on the body construction and the type of resiliently deformable material used. First and second connectors 7, 9 are attached with the first and second ends 3, 5 respectively. The first connector 7 is a key ring onto which one or more keys can be engaged and the second connector 9 is arranged to form a fastener for attaching to a belt, loop or clothing of a user.

The first end 3 and the second end 5 of the non-coiled body 2 are in the form of respective integrated continuous lobes 11, 13. The first and second ends 3, 5 are connected with the connectors 7, 9 through these integrated continuous lobes 11, 13 via apertures 11*a*, 13*a*.

The non-coiled body 2 is substantially oval or oblong in shape having a substantially round center region 100 integrally formed with the first and second ends 3, 5. The center region 100 is located between the first and second end 3, 5. Two badges 15, 17 are located adjacent the center region 100. Each of the badges 15, 17 is a non-elastic badge with a pair of legs 25, 27. These legs 25, 27 are inserted through the opening 23 of the center region 100 to join the two badges 15, 17.

The resiliently deformable material is a soft material, such as a gelatinous composition, an elastic non-sticky gel material or a melt blend admixture of poly (styrene-ethylene-butylene-styrene) triblock copolymer and plasticsing oils or a rigid material such as latex or rubber. The thickness of the non-coiled body 2 varies with the type of the resiliently deformable material. For soft materials, such as foamed latex, the body thickness has to be increased. The thickness of the non-coiled body is no less than 5 mm. When the resiliently deformable material is a SEBS gelatinous composition, the thickness of the non-coiled body is no less than 5 mm. For more rigid material, such as hard rubber, the non-coiled body thickness is reduced.

The non-coiled body 2 of the key chain is produced by injection molding.

When in use, the connector 7 is connected to a key and the connector 9 is arranged to connect with a belt, loop or clothing of users. The non-coiled body 2 is stretched, twisted or bent to bring the key towards a key hole. As soon as the user releases the non-coiled body 2, it returns to its retracted state.

It should be appreciated that modifications and alterations obvious to those skilled in the art are not to be considered as beyond the scope of the present invention. For example, in the preferred embodiment, the shape of the non-coiled body is substantially oval. In an alternative embodiment, the non-coiled body can be of any shape.

In the preferred embodiment, the badge is substantially circular. In an alternative embodiment, the badge can be of any shape, such as animals, balls, cartoon characters and logos.

In the preferred embodiment, the non-coiled body has two ends. In an alternative embodiment, the non-coiled body has two or more ends.

In the preferred embodiment, the non-coiled body has a thickness of 5 mm. In an alternative embodiment, the thickness varies according to the hardness of the resiliently deformable material.

In the preferred embodiment, the first and second ends of the non-coiled body form integrated continuous lobes on either end of the non-coiled body. In an alternative embodiment, the non-coiled body is a continuous ring of the resiliently deformable material having first and second end for connecting with first and second connectors.

What is claimed is:

1. A lanyard for keys comprising:

a non-coiled body made of a resilient deformable material having elastic memory and being stretchable from a retracted to an extended state, the non-coiled body having a substantially round centre region in which a pair of openings are disposed;

first and second lobes integral with the centre region and projecting from opposing sides of the centre region;

first and second ring connectors attached to the first and second lobes respectively; and two non-elastic badges, the badges being disposed on opposing sides of the centre region, each badge having a pair of legs, at least one leg of each pair extending through a respective one of the openings in the centre region to connect the badges.

2. The lanyard for keys of claim 1 wherein the resiliently deformable material is selected from the group consisting of an elastic non-sticky gel material, a gelatinous composition, a melt blend admixture of poly triblock copolymer and plasticizing oils, latex and rubber.

3. The lanyard for keys of claim 2 wherein the non-coiled body is formed by injection molding.

4. The lanyard for keys of claim 1 wherein the resilient deformable material is a SEBS gelatinous composition.

5. The lanyard for keys of claim 1 wherein in the extended state the non-coiled body has a length more than ten times the length its length in the retracted state.

6. A lanyard for keys comprising:

a non-coiled body made of a resilient deformable material having elastic memory and being stretchable from a retracted to an extended state, the non-coiled body having a centre region in which a pair of openings are disposed;

first and second lobes integral with the centre region and projecting from opposing sides of the centre region;

first and second ring connectors attached to the first and second lobes respectively;

two badges of non-elastic material wherein in said retracted state the badges substantially cover opposing sides of the centre region and the lobes project from the edges of the badges; and fastenings extending through the pair of openings in the centre region to connect the badges.

7. The lanyard for keys of claim 6 wherein the fastenings comprise first and second legs integral with each of the badges, both first legs extending through a first of the pair of openings and both second legs extending through a second of the pair of openings to connect the badges.

* * * * *